US006800051B2

(12) United States Patent
Koehn

(10) Patent No.: US 6,800,051 B2
(45) Date of Patent: Oct. 5, 2004

(54) PROCESS FOR MANUFACTURING SIDE FOLD SACKS MADE OF PLASTIC FILM

(75) Inventor: Uwe Koehn, Osnabrueck (DE)

(73) Assignee: Windomeller & Hoelscher, Lengerich (DE)

( * ) Notice: Subject to any disclaimer, the term of this patent is extended or adjusted under 35 U.S.C. 154(b) by 53 days.

(21) Appl. No.: 10/062,461

(22) Filed: Feb. 5, 2002

(65) Prior Publication Data

US 2002/0107128 A1 Aug. 8, 2002

(30) Foreign Application Priority Data

Feb. 6, 2001 (DE) ..... 101 06 289

(51) Int. Cl.[7] ..... B31B 1/14

(52) U.S. Cl. ..... 493/227; 493/223; 493/199; 493/218; 493/235

(58) Field of Search ..... 493/162, 168, 493/177, 178, 194, 199, 203, 218, 223, 227, 235, 239, 258, 228; 53/482, 375.7, 372.7

(56) References Cited

U.S. PATENT DOCUMENTS

| | | | | | |
|---|---|---|---|---|---|
| 442,839 | A | * | 12/1890 | West | |
| 1,986,043 | A | * | 1/1935 | Carter | 53/482 |
| 2,156,441 | A | * | 5/1939 | Hugo et al. | 53/477 |
| 2,575,544 | A | * | 11/1951 | Zinn, Jr. | 53/484 |
| 3,008,569 | A | * | 11/1961 | Murch | |
| 3,385,428 | A | * | 5/1968 | Kugler | |
| 3,390,617 | A | * | 7/1968 | Cloud et al. | |
| 3,534,520 | A | * | 10/1970 | Moran | 53/416 |
| 3,857,329 | A | * | 12/1974 | Lehmacher et al. | |
| 4,426,035 | A | * | 1/1984 | Dieckow | 206/526 |
| 4,566,927 | A | * | 1/1986 | Wood | |
| 4,603,537 | A | * | 8/1986 | Pace | 53/415 |
| 4,889,523 | A | * | 12/1989 | Sengewald | 493/235 |
| 5,390,473 | A | * | 2/1995 | Nelson et al. | 53/417 |

FOREIGN PATENT DOCUMENTS

| | | |
|---|---|---|
| DE | 28 01 963 | 7/1979 |
| DE | 44 31 742 | 3/1996 |

* cited by examiner

*Primary Examiner*—Eugene Kim
*Assistant Examiner*—Sameh H. Tawfik
(74) *Attorney, Agent, or Firm*—Jacobson Holman PLLC

(57) ABSTRACT

A method for manufacturing side fold sacks from a flat lying segment of a web of plastic tubular film provided with side folds. According to the method, the bottom end of the segment is provided in such a manner with a staggered cut or a staggered detachment along a perforation that a staggered portion is formed in which the rear wall projects beyond the front wall. Adhesive is applied to the staggered portion up to the area of a fold line, which is located adjacent the edge of the front wall that has been cut free. The staggered portion is then folded over the fold line and adhered onto the front wall to seal the bottom end of the side fold sack.

14 Claims, 1 Drawing Sheet

PROCESS FOR MANUFACTURING SIDE FOLD SACKS MADE OF PLASTIC FILM

BACKGROUND OF THE INVENTION

1. Field of the Invention

The invention relates to a process for manufacturing side fold sacks from a flat lying segment of a web of plastic tubular film.

2. Description of the Related Art

Side fold sacks made of plastic, for example polyolefin films, like PE and PP, are manufactured from flat lying segments of a web of plastic tubular film by providing a weld, which runs at right angles and grasps all layers, on one end. Owing to the typically high weight of the fill material and the resulting load on the sacks, said sacks are usually made of especially thick plastic films. On tubular segments made of plastic films of such thickness the bottoms can be affixed only by means of transverse welds, whose execution requires a long welding time. The welding operation requires that the heat be passed through all of the layers of film which, in the area of the side folds, requires heat passage through four layers of film, in order to guarantee the requisite melting and welding together. This thermal conductivity process time, which increases as the thickness of the film and the number of layers increase, results in a significantly long welding period so that the sacks can be manufactured only at low efficiency.

SUMMARY OF THE INVENTION

Therefore, the object of the invention is to propose a process of the type described in the introductory part and according to which side fold sacks made of plastic film can be manufactured with greater efficiency.

The invention solves this problem in that one end of the segment of a web of plastic tubular film is provided in such a manner with a staggered cut or a staggered detachment along a perforation that, in a top view of the staggered portion, the rear wall projects beyond the front wall. The upper surfaces of the staggered portion are provided with an application of adhesive as far as into the area of a fold line, which is located adjacent the free bottom edge of the front wall, and the staggered portion is folded along the fold line and over the free edge to be affixed onto the front wall. Such a process for manufacturing side fold sacks made of paper already exists. The invention is based on the surprising knowledge of the benefit of transferring this process to the manufacture of paper sacks, where the bottoms were affixed hitherto by means of welds.

Plastic adhesives, for example polyurethane adhesive or hot melt, are used as the adhesive to cement the folded over staggered portion to the front wall.

The cementing operation can be improved by further subdividing the staggered portion. Expediently, when viewed from above, a portion of the rear wall projects beyond the side folds, and a portion of the side folds project beyond the front wall.

The staggering of the layers may be further increased by forming the side folds in such a manner that the bottom layers of the side folds project beyond the upper layers.

A preferred embodiment provides that the perforation lines are formed in a flat lying web of plastic at intervals equal to the length of the segments of a web of plastic tubular film, before the segments are separated. The side fold tubular web is formed by folding the web sides so as to overlap and simultaneously inserting side folds and affixing a center weld which runs lengthwise. Thus, starting from the part that forms the rear wall, the perforation lines pass in steps over those parts that form the side folds into the part that forms the front wall, whereby the transverse segments of the perforation line are parallel to each other. One embodiment of the invention is explained in detail below with reference to the drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
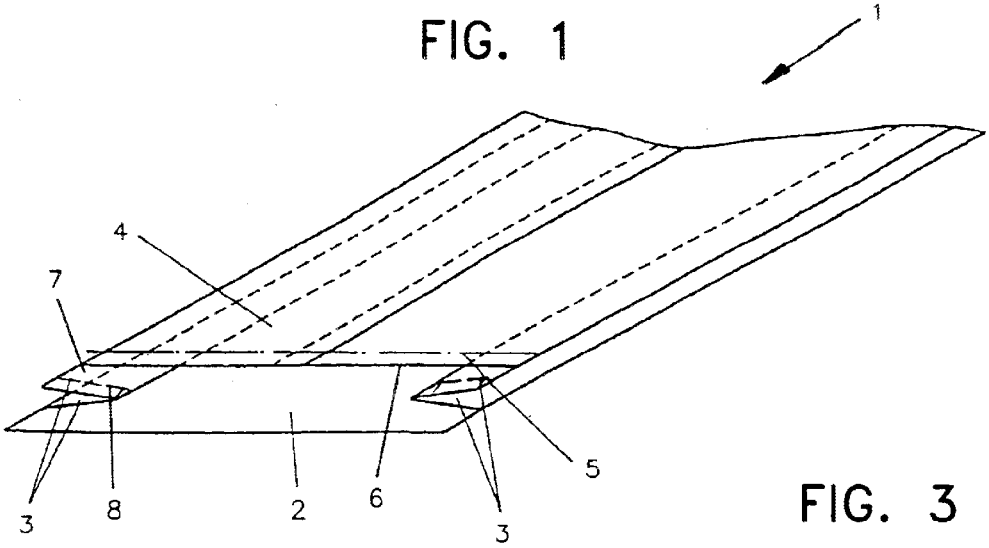
FIG. 1 is a perspective view of one end of a flat lying segment of a web of plastic tubular film, which is provided with side folds, the end being provided with a staggered detachment.

FIG. 1 depicts a segment 1 of a web of plastic tubular film, severed along a perforation line from a flat lying web of plastic tubular film, which is provided with side folds. The perforation lines are provided in such a manner with graduations or steps, that the segment has a staggered end, which is evident from FIG. 1.

The staggering of the layers on the end of the segment of the web of tubular film, where the cemented bottom is to be formed, is designed in such a manner that in a top view of the segment 1, the rear wall 2 projects beyond the side folds 3, while the side folds project beyond the front wall 4, with the front wall being provided with a corresponding free edge 6. The perforation line, along which the segment is severed from the web of tubular film to form the staggered end, is already formed in the flat web of film, from which then the web of tubular film is formed by folding the side parts so as to overlap and simultaneously inserting the side folds and affixing a longitudinal center weld.

Figure 2:
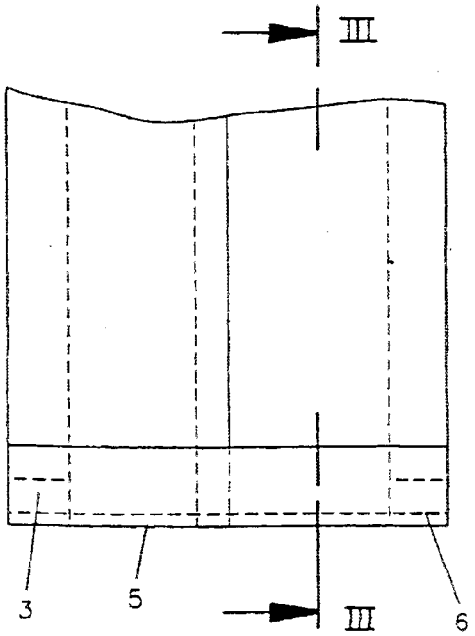
FIG. 2 is a top view of the bottom of a plastic side fold sack, the bottom being formed by cementing.

To manufacture side fold sacks, the upper surfaces of the staggered or stepped portions of the rear wall 2 and of the side folds 3 are provided with a suitable application of adhesive. The staggered portions are then folded over the fold line 5 and pressed against the front wall 4 so that the result is the cemented bottom, illustrated in FIG. 2.

Figure 3:
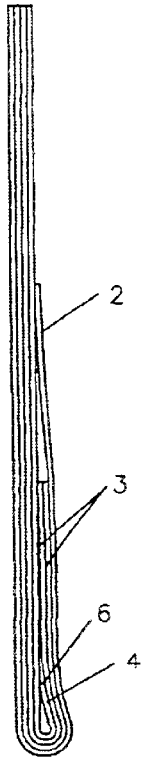
FIG. 3 is a cross sectional view along line III—III of FIG. 2.

The position of the staggered portions of the rear wall 2, the side folds 3 and that part of the front wall 4 adjacent the free edge 6 in the finished, cemented side fold sack is shown in FIG. 3. As shown, a portion of the front wall between the fold line and the free edge 6 may also be adhered back against the upper surface of the front wall.

Another embodiment provides that the upper layer 7 of the side folds is also provided with a staggered cut along the dashed lines 8 in FIG. 1 so that the bottom layer of the side fold projects beyond the upper layer 7.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A process for manufacturing a side fold sack from a flat lying segment of a web of plastic tubular film, said segment having a rear wall and a front wall joined with side folds, the process comprising the steps of:

providing a bottom end of the flat lying segment of plastic tubular film with a staggered portion in which the rear wall projects beyond the front wall, said staggered portion formed by providing a staggered detachment along a perforation line such that a portion of the rear wall projects beyond the side folds and a portion of the side folds projects beyond the front wall;

applying an adhesive to upper surfaces of the projecting portions of the rear wall and side folds; and folding the staggered portion along a fold line located adjacent and generally parallel to a free edge of said front wall at said bottom end and adhering said staggered portion onto said front wall to seal the bottom end of the side fold sack.

2. The process as set forth in claim 1, wherein the step of providing the staggered portion includes providing the staggered detachment along the perforation line such that a bottom layer of the side folds projects beyond an upper layer of said side folds.

3. The process as set forth in claim 1, wherein the step of providing the staggered portion includes providing the staggered detachment along perforation lines which are affixed on the flat laying plastic web at intervals equal to a length of the segment, before said segment is added to a side fold tubular web, by folding sides of the web so as to overlap and simultaneously inserting the side folds and affixing a center weld which runs lengthwise.

4. The process as set forth in claim 3, wherein, starting from the rear wall, the perforation lines are graduated, passing in steps over those parts that form the side folds into the front wall, transverse segments of the graduated perforation lines being parallel to each other.

5. A process for manufacturing a sack with side folds from a flat lying segment of a web of plastic tubular film, said segment having a rear wall and a front wall joined with the side folds, the process comprising the steps of:

cutting a bottom end of the flat lying segment of plastic tubular film such that a portion of the rear wall projects beyond a bottom edge of the front wall to form a staggered portion;

applying an adhesive to the staggered portion up to a fold line in said front wall, said fold line being substantially parallel with said bottom edge of said front wall; and folding the staggered portion along the fold line and adhering said staggered portion onto said front wall to seal the bottom end of the sack, a portion of said front wall between the fold line and said bottom edge also being adhered to said front wall.

6. The process as set forth in claim 5, wherein the step of cutting includes providing a staggered cut such that the rear wall projects beyond the side walls and the side walls project beyond the front wall.

7. The process as set forth in claim 6, wherein in the step of folding, a portion of said front wall between the fold line and said bottom edge, and projecting portions of said side walls are also adhered to said front wall.

8. The process as set forth in claim 5, wherein the step of cutting includes providing a staggered cut such that a bottom layer of the side folds projects beyond an upper layer of said side folds.

9. The process as set forth in claim 8, wherein in the step of folding, a portion of said front wall between the fold line and said bottom edge, and the bottom layer of said side walls are also adhered to said front wall.

10. The process as set forth in claim 5, wherein the step of cutting includes providing a staggered detachment along perforation lines which are affixed on the flat laying plastic web at intervals equal to a length of the segment, before said segment is added to a side fold tubular web, by folding sides of the web so as to overlap and simultaneously inserting the side folds and affixing a center weld which runs lengthwise.

11. The process as set forth in claim 10, wherein, starting from the rear wall, the perforation lines are graduated, passing in steps over those parts that form the side folds into the front wall, transverse segments of the graduated perforation lines being parallel to each other.

12. A process for manufacturing a side fold sack from a flat lying segment of a web of plastic tubular film, said segment having a rear wall and a front wall joined with side folds, the process comprising the steps of:

providing a bottom end of the flat lying segment of plastic tubular film with a staggered portion in which the rear wall projects beyond the front wall, said staggered portion formed by providing a staggered detachment along a perforation line such that a bottom layer of the side folds projects beyond an upper layer of said side folds;

applying an adhesive to upper surfaces of the projecting portions of the rear wall and side folds; and folding the staggered portion along a fold line located adjacent and generally parallel to a free edge of said front wall at said bottom end and adhering said staggered portion onto said front wall to seal the bottom end of the side fold sack.

13. A process for manufacturing a sack with side folds from a flat lying segment of a web of plastic tubular film, said segment having a rear wall and a front wall joined with the side folds, the process comprising the steps of:

cutting a bottom end of the flat lying segment of plastic tubular film such that a portion of the rear wall projects beyond the side folds and a portion of the side folds projects beyond a bottom edge of the front wall to form a staggered portion;

applying an adhesive to upper surfaces of the projecting portions of the rear wall and side folds; and folding the staggered portion along a fold line located adjacent and substantially parallel to the bottom edge of the front wall and adhering said staggered portion onto said front wall to seal the bottom end of the sack.

14. A process for manufacturing a sack with side folds from a flat lying segment of a web of plastic tubular film, said segment having a rear wall and a front wall joined with the side folds, the process comprising the steps of:

cutting a bottom end of the flat lying segment of plastic tubular film such that the rear wall projects beyond a bottom edge of the front wall and a bottom layer of the side folds projects beyond an upper layer of said side folds, to form a staggered portion;

applying an adhesive to upper surfaces of the staggered portion; and folding the staggered portion along a fold line located adjacent and substantially parallel to the bottom edge of the front wall and adhering said staggered portion onto said front wall to seal the bottom end of the sack.

* * * * *

UNITED STATES PATENT AND TRADEMARK OFFICE

CERTIFICATE OF CORRECTION

PATENT NO. : 6,800,051 B2
APPLICATION NO. : 10/062461
DATED : October 5, 2004
INVENTOR(S) : Uwe Koehn It is certified that error appears in the above-identified patent and that said Letters Patent is hereby corrected as shown below:

In Col. 1, line 49, change "manufacture of paper sacks" to "manufacture of plastic sacks".

Signed and Sealed this

Seventeenth Day of August, 2010

David J. Kappos

David J. Kappos
*Director of the United States Patent and Trademark Office*

US006800051C1

(12) EX PARTE REEXAMINATION CERTIFICATE (5917th)

United States Patent
Koehn

(10) Number: US 6,800,051 C1
(45) Certificate Issued: Oct. 2, 2007

(54) PROCESS FOR MANUFACTURING SIDE FOLD SACKS MADE OF PLASTIC FILM

(75) Inventor: Uwe Koehn, Osnabrueck (DE)

(73) Assignee: Windmoeller & Hoelscher, Lengerich (DE)

Reexamination Request:
No. 90/008,036, May 25, 2006

Reexamination Certificate for:

| | |
|---|---|
| Patent No.: | **6,800,051** |
| Issued: | **Oct. 5, 2004** |
| Appl. No.: | **10/062,461** |
| Filed: | **Feb. 5, 2002** |

(51) Int. Cl.
*B31B 1/14* (2006.01)

(52) U.S. Cl. ..... 493/227; 493/199; 493/218; 493/223; 493/235

(58) Field of Classification Search ..... 493/199, 493/218, 223, 227, 235
See application file for complete search history.

(56) References Cited

FOREIGN PATENT DOCUMENTS

| | | |
|---|---|---|
| CA | 775426 | 1/1968 |
| CA | 875950 | 7/1971 |

*Primary Examiner*—Jimmy G. Foster

(57) ABSTRACT

A method for manufacturing side fold sacks from a flat lying segment of a web of plastic tubular film provided with side folds. According to the method, the bottom end of the segment is provided in such a manner with a staggered cut or a staggered detachment along a perforation that a staggered portion is formed in which the rear wall projects beyond the front wall. Adhesive is applied to the staggered portion up to the area of a fold line, which is located adjacent the edge of the front wall that has been cut free. The staggered portion is then folded over the fold line and adhered onto the front wall to seal the bottom end of the side fold sack.

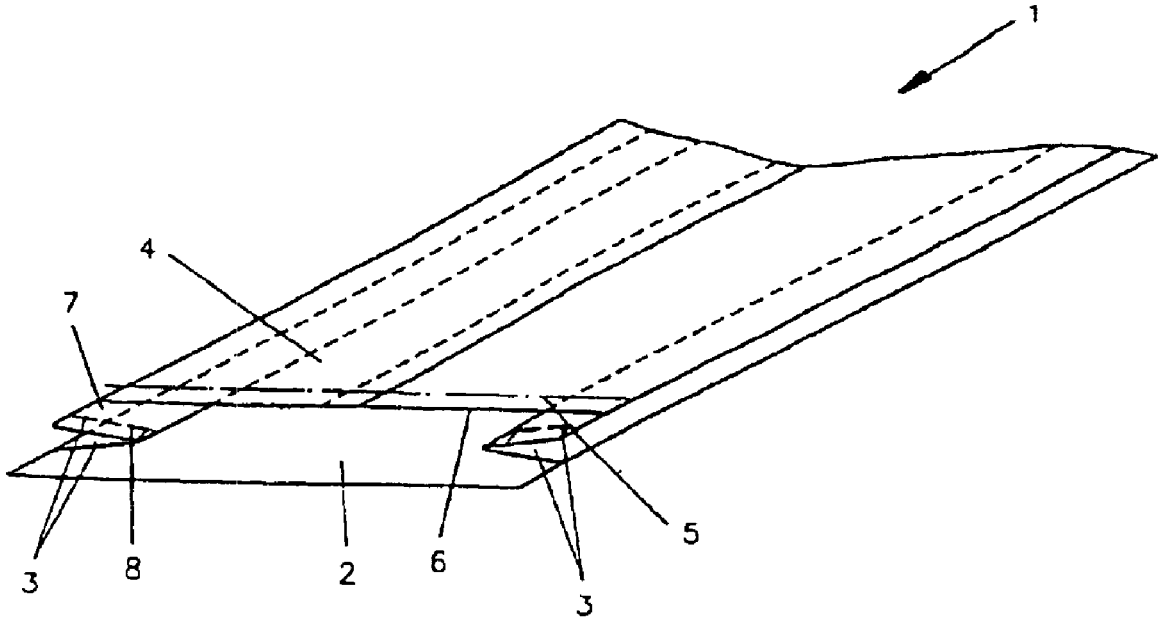

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–14 is confirmed.

* * * * *